US006106442A

United States Patent [19]

Tissue

[11] Patent Number: 6,106,442

[45] Date of Patent: Aug. 22, 2000

[54] CROSS COUNTRY SKIING SKATE TRAINER

[76] Inventor: Stan D. Tissue, 6418 Old Nat'l. Pike, Boonsboro, Md. 21713

[21] Appl. No.: 08/762,521

[22] Filed: Dec. 9, 1996

[51] Int. Cl.[7] ..... A63B 69/18

[52] U.S. Cl. ..... 482/71; 482/70; 482/51

[58] Field of Search ..... 434/253; 482/70, 482/71, 51, 54

[56] References Cited

U.S. PATENT DOCUMENTS

| | | | |
|---|---|---|---|
| 3,650,528 | 3/1972 | NaHerer . | |
| 3,791,695 | 2/1974 | Stelma | 482/71 |
| 4,650,184 | 3/1987 | Brebner | 482/71 |
| 4,744,557 | 5/1988 | Smirmaul | 482/71 |
| 4,867,443 | 9/1989 | Jensen | 482/70 |
| 4,906,192 | 3/1990 | Smithard et al. | 482/70 |
| 4,960,276 | 10/1990 | Feuer et al. | 482/70 |
| 5,443,433 | 8/1995 | Krag | 482/70 |
| 5,460,586 | 10/1995 | Wilkinson et al. | 482/54 |
| 5,692,995 | 12/1997 | Alvarez et al. | 482/71 |

FOREIGN PATENT DOCUMENTS

| | | | |
|---|---|---|---|
| 2581551 | 11/1986 | France | 482/71 |
| 2333097 | 1/1975 | Germany | 482/71 |

*Primary Examiner*—Jerome W. Donnelly
*Attorney, Agent, or Firm*—Barnes & Thornburg

[57] ABSTRACT

A ski exercise apparatus for simulating cross-skiing activity which permits variable resistive horizontal pivoting of skis about a vertical axis while allowing vertical lifting of the skis and which also allows pivoting of a ski binding about a horizontal axis of the ski by a user practicing skiing. Also provided is a ski pole support which allows vertical and horizontal pivoting of a ski pole by the user as well as provides resistance to back and forth movement of the ski pole.

19 Claims, 13 Drawing Sheets

CROSS COUNTRY SKIING SKATE TRAINER

BACKGROUND OF THE INVENTION

Field of the Invention

The invention is a stationary training system for practicing the specific cross country skiing V1/V2 and Diagonal skating disciplines. While there are training systems available for the classic cross country skiing technique, there are currently no available stationary systems for the newer V1/V2 and Diagonal skating techniques. The only currently available option to a skier wishing to practice these techniques off snow is to use roller skis and poles. This type of training is normally done on public roads and can be hazardous due to variations in surface conditions (i.e., gravel, pavement) and traffic.

The invention enables a skier to practice the V1/V2 and Diagonal Skating techniques safely, and independent of weather conditions, on a stationary system.

SUMMARY OF THE INVENTION

The invention is a stationary training system that is designed to enable a skier to practice the precise physical motions of the specific techniques of cross country skiing known as V1/V2 and Diagonal skating. Mechanical systems for pole push and leg stride enable the skier to duplicate the actual motions of each of these techniques with adjustable resistance levels. An illustration of the actual system in use is provided in FIGS. 13(A) and 13(B), which show a user on the apparatus at the start of the ski stride and at the end of the ski stride, respectively. Background information on the V1/V2 and Diagonal skating technique is provided in Exhibit A, an excerpt from "Cross Country Skier" Magazine Volume 14, Issue 3 entitled "Skating: Shifting Gears".

The invention provides a means of inducing a variable resistance to the skiers skating stride through two ski levers which drive unidirectional clutch equipped wheels. Mechanical drag is induced to the wheels by a belt which is adjusted from a central location. The twin ski levers are independent, i.e., the skier can stride with one leg while the other leg remains stationary to simulate skiing through turns. A biaxial binding mounting system provides a platform for mounting any of the standard cross country binding systems and allows full rotation of the ankle during each stride. The ski levers rotate through a large arc to provide an accurate simulation of the actual beginning and ending foot location. The ski lever is also free to rotate through a vertical axis so that the entire assembly can be raised and returned to start the next stride just as a skier would on snow. The binding mounting system location is linearly adjustable to fit a wide range of strides.

Ultra High Molecular Weight Polyethylene (UHMWP) Skid pads support each ski lever on a maple composite skid pad and are shaped to encourage proper ski edge control technique. On snow, the skier weights the outside edge of the gliding ski during the start of a stride and rolls his/her ankle so that the ski rotates from outside edge, to flat, to inside edge as the stride is completed. The skid pads also have outside edges which provide traction for the stationary or gliding leg during the start of a stride to resist the force applied to the striding ski lever. Just as in actual V1/V2 skating, the striding ski can be weighted on the inside edge by rotating the ankle. On snow, the ski edge cuts into the snow providing an area to exert pressure against. On the training system, weighting the inside of the ski lever prevents the outside edge from resisting the applied force while the pulley/belt mechanism supplies the desired resistance level.

Two independent pole drive resistance units accept standard 16 MM diameter cross country ski poles and offer resistance through a combination of roller clutch and idler cast urethane wheels driving a flywheel. The resistance units are attached to the supporting frame by a two axis linkage which enables the skier to duplicate the exact arm swing that they would use in V1/V2 and Diagonal skating. As the pole is pushed through the system, the roller clutch equipped urethane wheel drives a flywheel spindle. As the pole is returned through the system, there is no flywheel resistance.

REFERENCE TO DRAWINGS

DESCRIPTION OF THE PREFERRED EMBODIMENT

Figure 1:
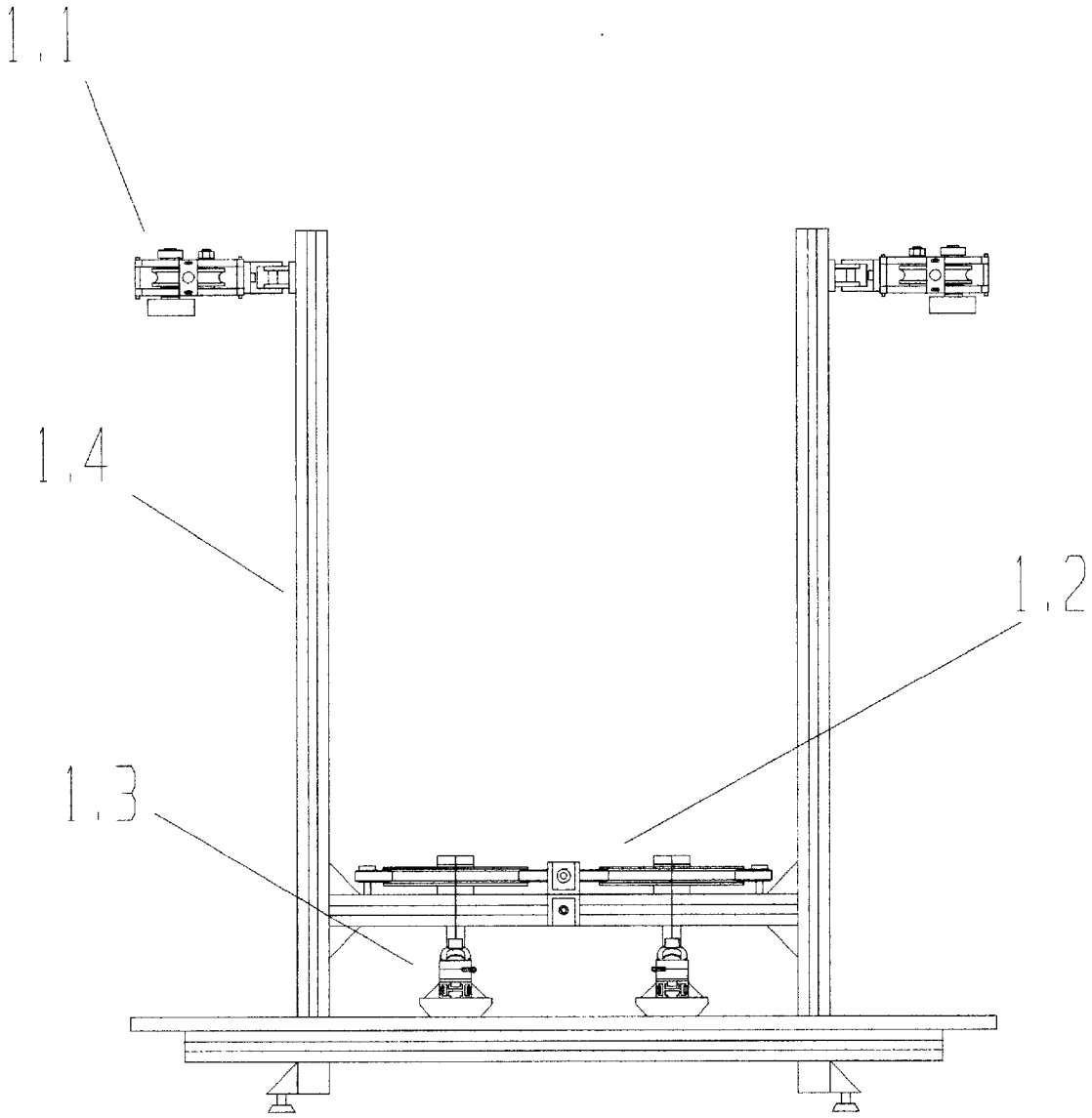
FIG. 1: Front Elevation of the Invention

FIG. 1 illustrates a front elevation view of the invention. 1.1 Refers to the Pole Drive assembly through which two 16 mm ski poles are pushed. These systems are linked to the uprights of the frame by a bi-axial linkage which facilitates an arm swing similar to on snow skiing. 1.2 Refers to the Ski Lever Resistance System, which comprises two drive wheels, a stationary resistance belt and a central tensioner. The system creates a resisting drag on the rotation of the ski lever when the skier strides. Through the use of a unidirectional clutch in the drive wheel hub, the wheel is only driven during the stride and offers no resistance when the skier returns his/her foot to the gliding position. 1.3 refers to the Ski Lever Assembly shown with standard cross country ski bindings attached. The levers are shown in the gliding position, or start of stride location. The Binding Base Systems facilitate the use of standard cross country skiing bindings and are hinged so that the skiers ankle can rotate as if to turn the ski on edge to cut into the snow. The Binding Base System is also mounted on a central spindle which allows the position of the skiers foot to closely approximate the actual motion of the foot during a stride on snow. 1.4 refers to the main frame which is constructed of slotted extruded aluminum tubing enabling height adjustment of the Pole Drive Systems and location adjustment of the Binding Base Systems along the Ski Lever axis.

Figure 2:
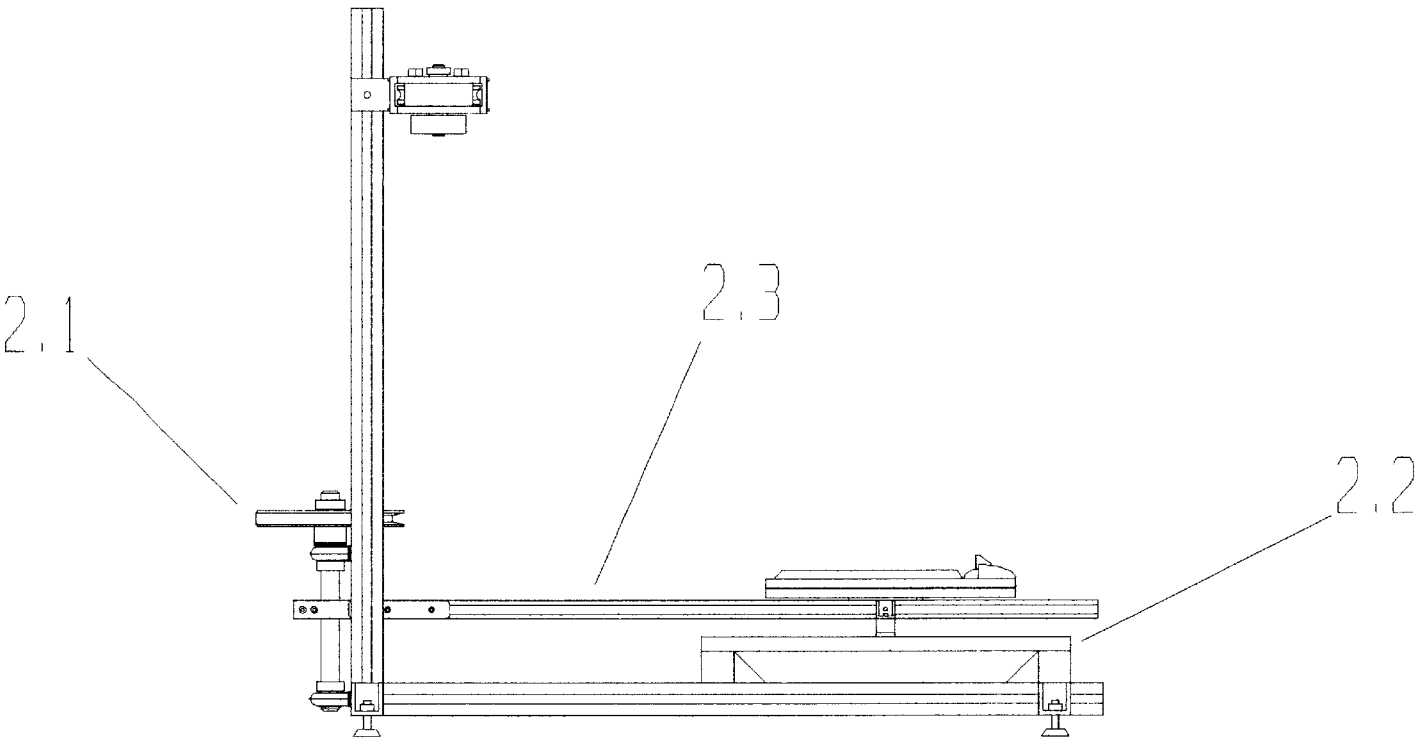
FIG. 2: Side Elevation of the Invention

FIG. 2 illustrates the side elevation of the invention. 2.1 Refers to the Ski Lever Resistance Spindle Assembly, showing the spindle, drive hub and thrust and radial bearings, as well as the aforementioned drive wheel and resistance belt. 2.2 Refers to the Skid Plate, which is a maple ply composite. The UHMWP skid blocks on the skis glide on this material with little friction while affording sufficient traction to push off against the gliding ski. 2.3 refers to the side view of the Ski Lever Assembly illustrating the general arrangement.

Figure 3:
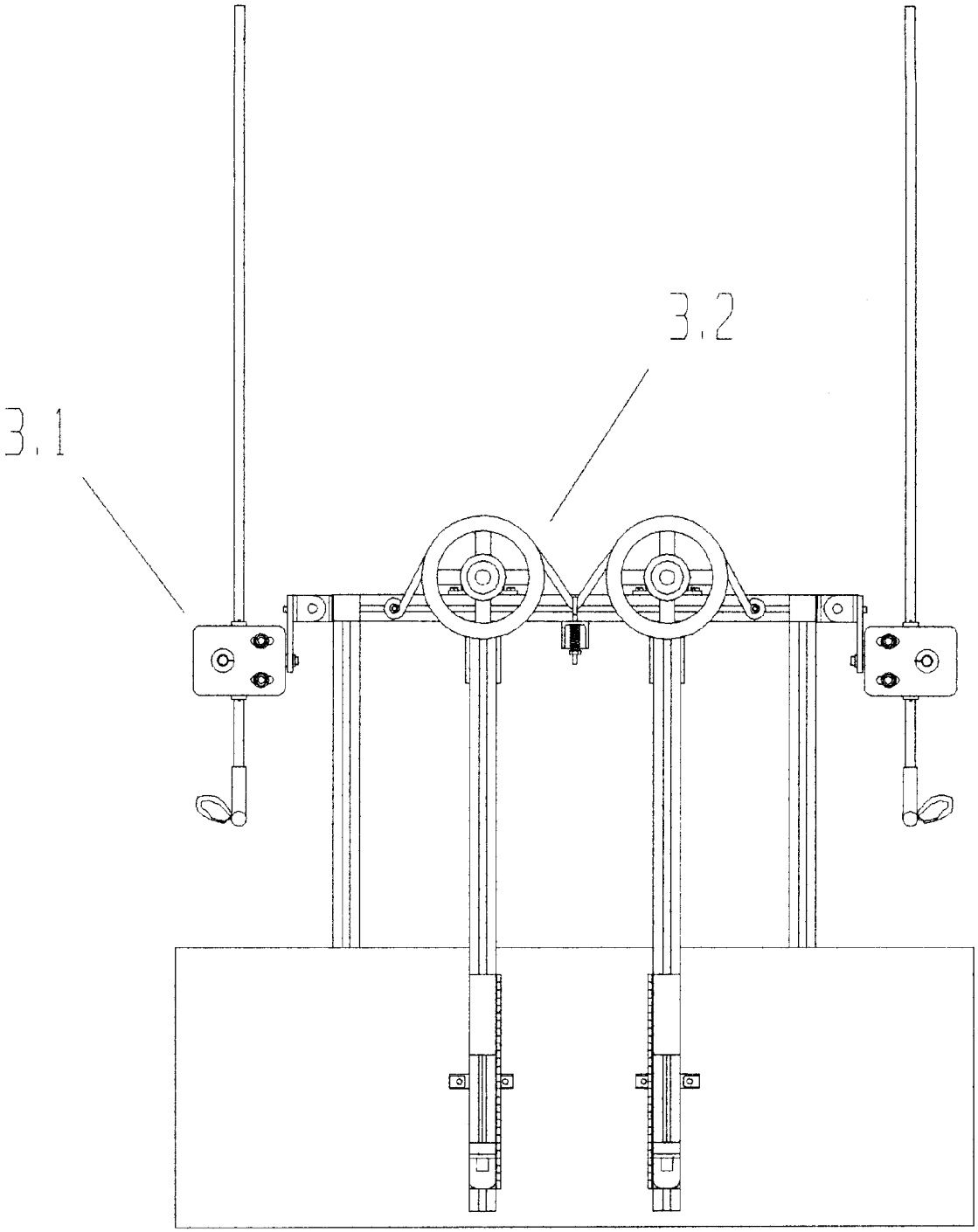
FIG. 3: Plan View of the Invention

FIG. 3 illustrates the plan or top view of the invention. 3.1 refers to the Pole Drive Systems with 16 mm ski poles inserted through the drives. The poles are pushed through the Pole Drive Systems which provide an inertial resistance. 3.2 refers to the top view of the Ski Lever Resistance system, showing the fixed positions for the resistance belt and the tensioner arrangement.

Figure 4:
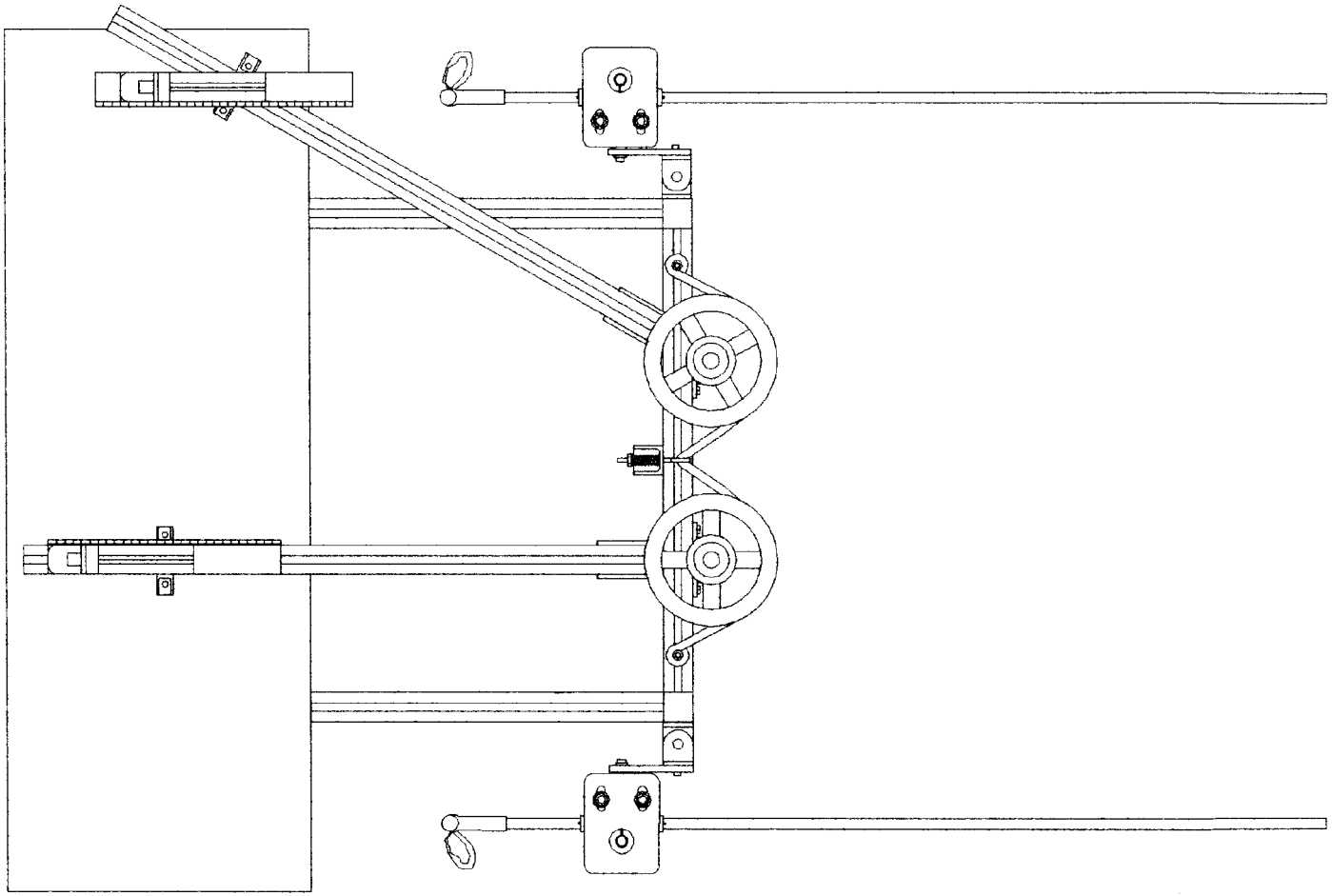
FIG. 4: Plan View with Ski Lever in end of stroke position

FIG. 4 illustrates the rotary motion of the Ski Lever and the free rotation of the Binding Base System on the Ski Lever. This feature allows the skiers foot to follow a path similar to on snow skiing. The Binding Base System can be rotated to simulate various ski angles of attack, from nearly parallel for flat terrain skiing, to 45 degrees for steep climbing.

Figure 5:
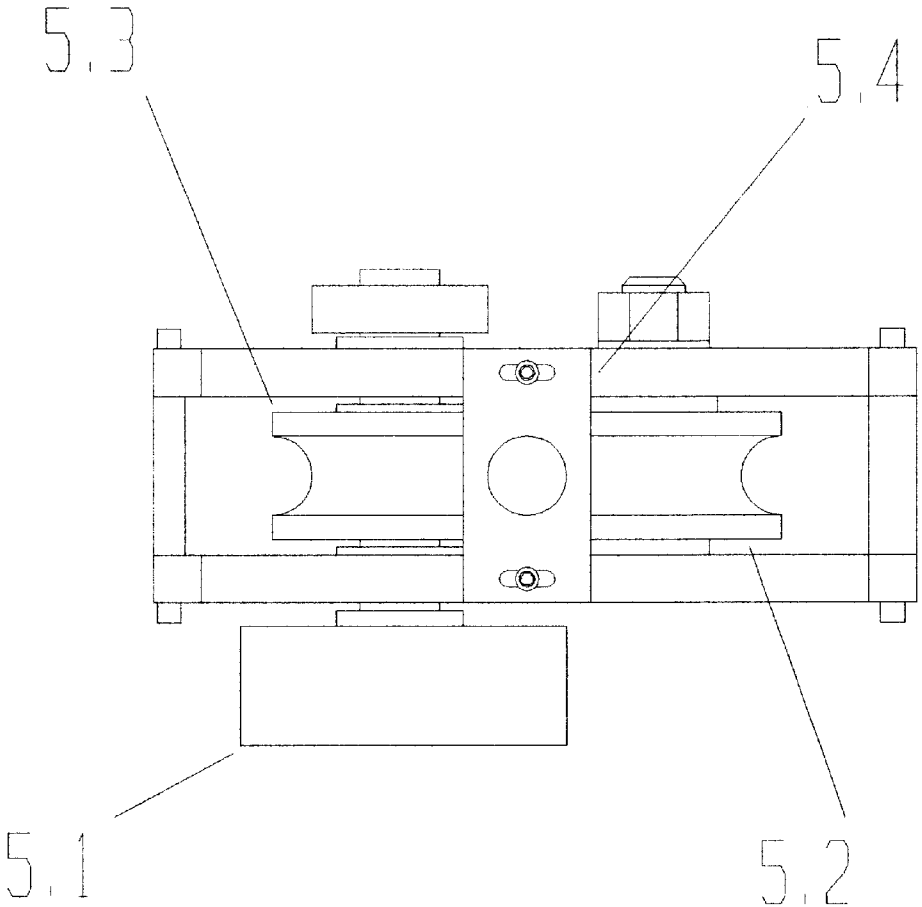
FIG. 5: Pole Drive Front View

FIG. 5 illustrates the Pole Drive front view. 5.1 refers to the Fly Wheel. The system provides a resistance to the skiers pole push through the work required to spin the Flywheel. A standard 16 mm diameter ski pole is captured in the system by two cast urethane Idler Wheels, 5.2 which can be adjusted to force the pole against the cast urethane Drive Wheel, 5.3. Fitted in the Drive Wheel is a uni-directional clutch/bearing which drives the Flywheel when the pole is pushed through the system, and allows the pole to return without driving the Flywheel when the pole is pulled back through the system. Two outboard Pole Guides, 5.4, locate the pole in the vertical plane, while the Idler and Drive Wheels locate the pole in the horizontal plane.

Figure 6:
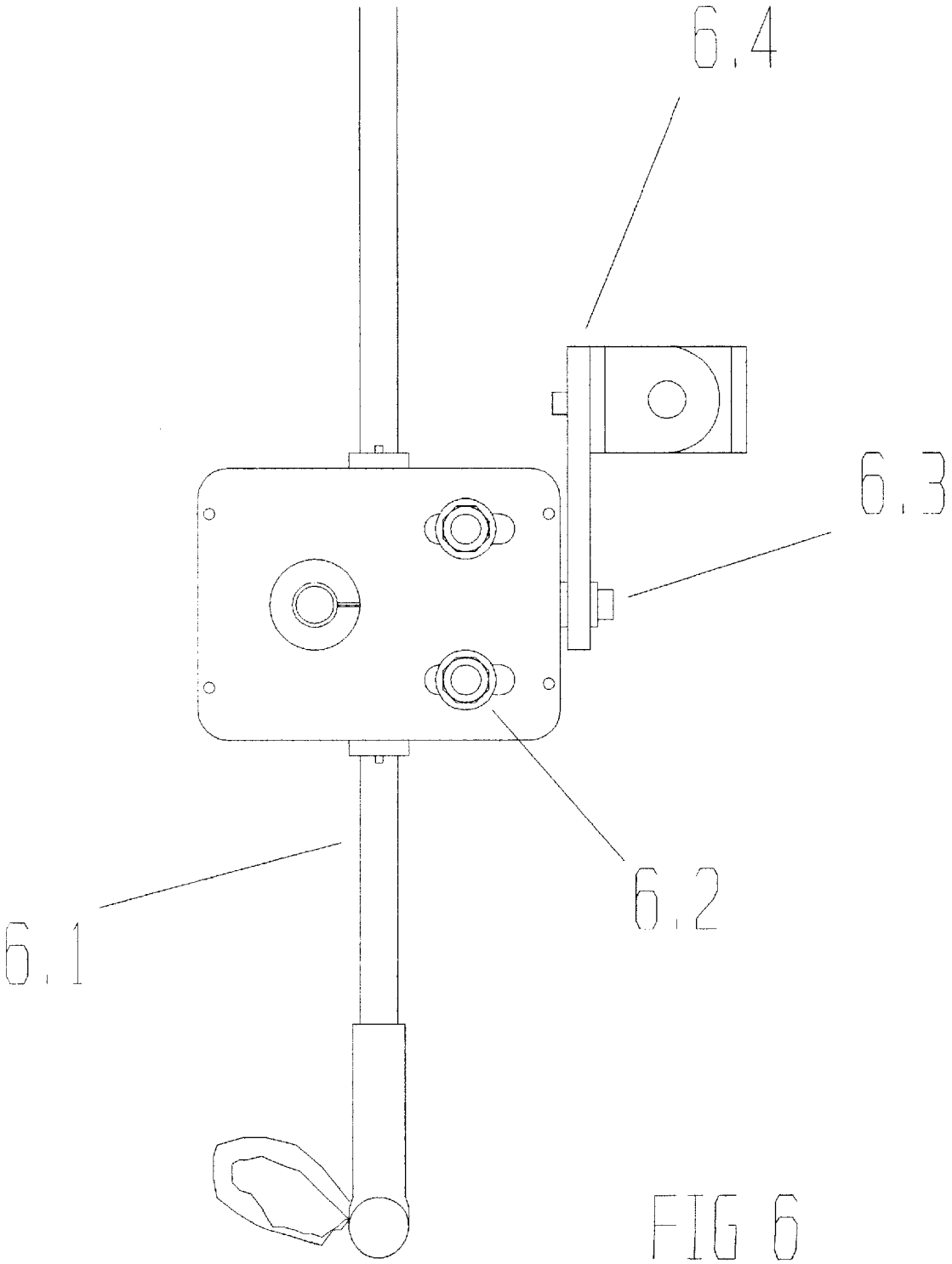
FIG. 6: Pole Drive Plan View

FIG. 6 shows a plan view of the Pole Drive System with a ski pole inserted through the system. 6.1 refers to the Ski Pole. 6.2 shows the Idler Wheel Spindle locations. A bi-axial linkage allows full freedom of arm swing during the push and return pole motion. 6.3 refers to the Vertical Plane Pivot. 6.4 refers to the Horizontal Plane Pivot.

Figure 7:
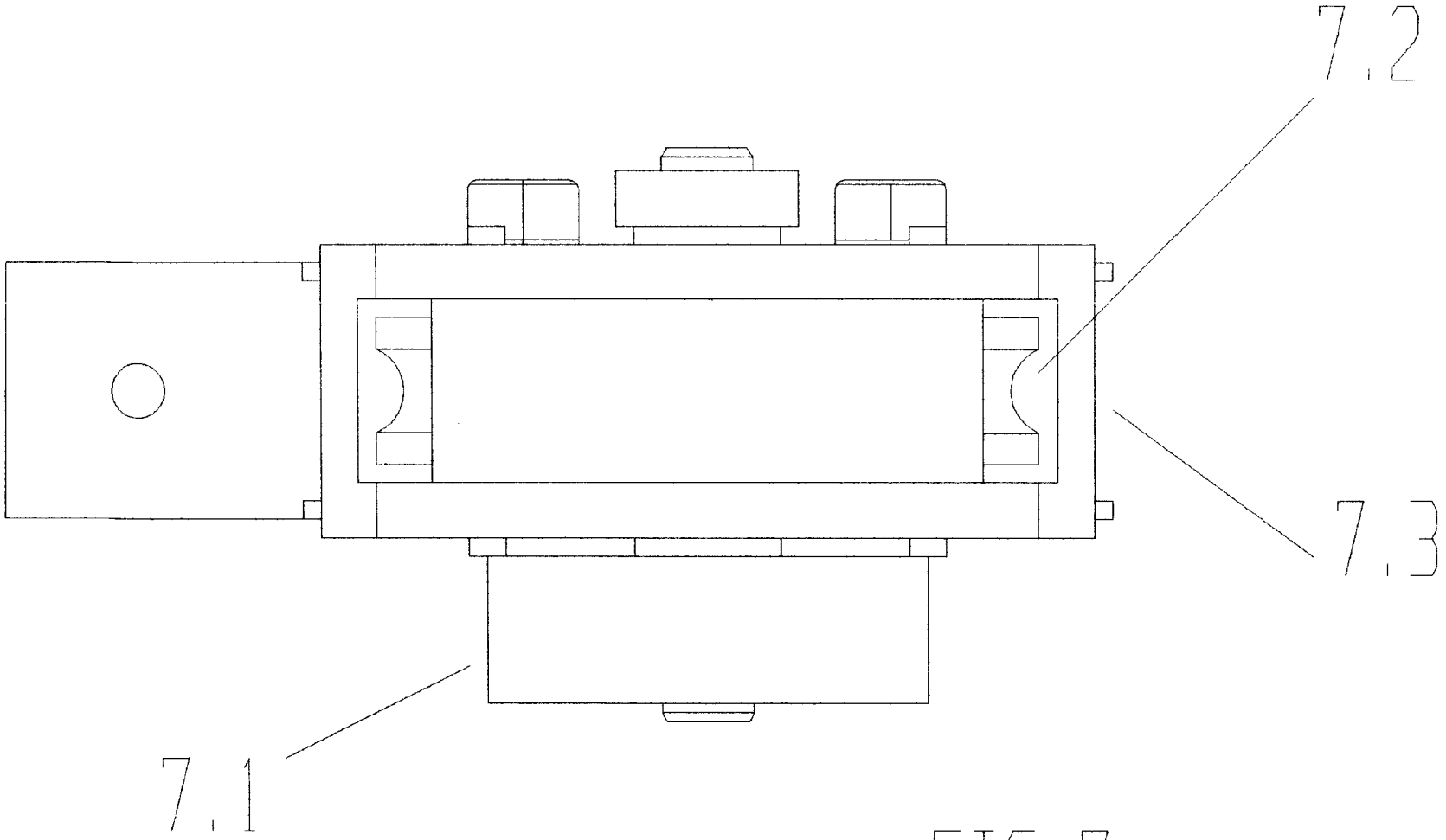
FIG. 7: Side elevation of Pole Drive detail

Shown in FIG. 7 is a side elevation of the Pole Drive. 7.1 refers to the Flywheel. 7.2 refers to the Idler Wheel and illustrates the profile of the wheel surface. The surface of the Drive and Idler Wheels is ground to a radius which provides maximum pole engagement to enhance traction. 7.3 refers to the Pole Guide.

Figure 8:
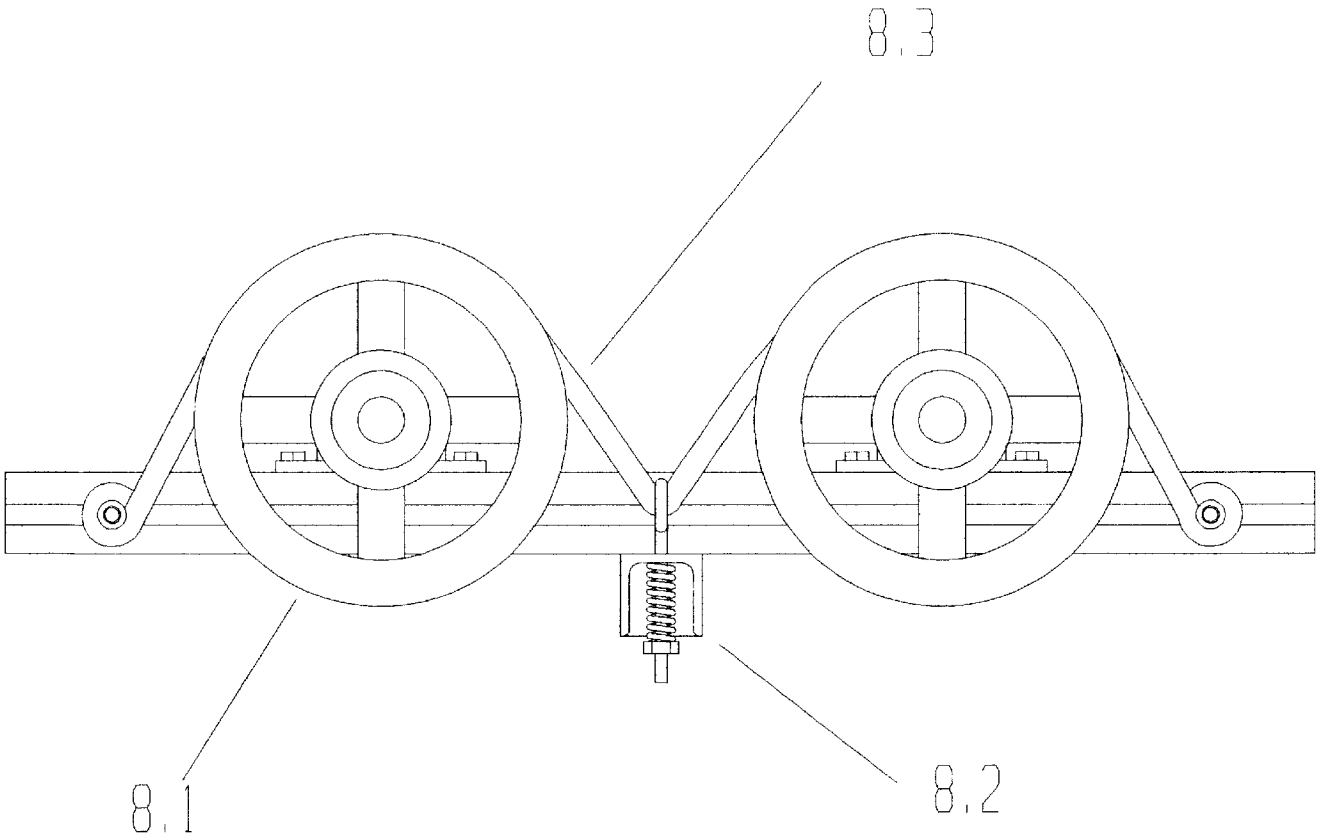
FIG. 8: Plan View of Ski Lever Resistance System

Shown in FIG. 8 is a top or plan view of the Ski Lever Resistance System. 8.1 refers to the Drive Wheel. 8.2 shows the Central Tensioner spring mechanism. 8.3 shows the stationary V Belt wrapped around the two drive wheels and through the tensioner. This system provides the skier with a simple means of increasing or decreasing the effort required for each stride and is designed so that the resistance at each lever is nearly identical.

Figure 9:
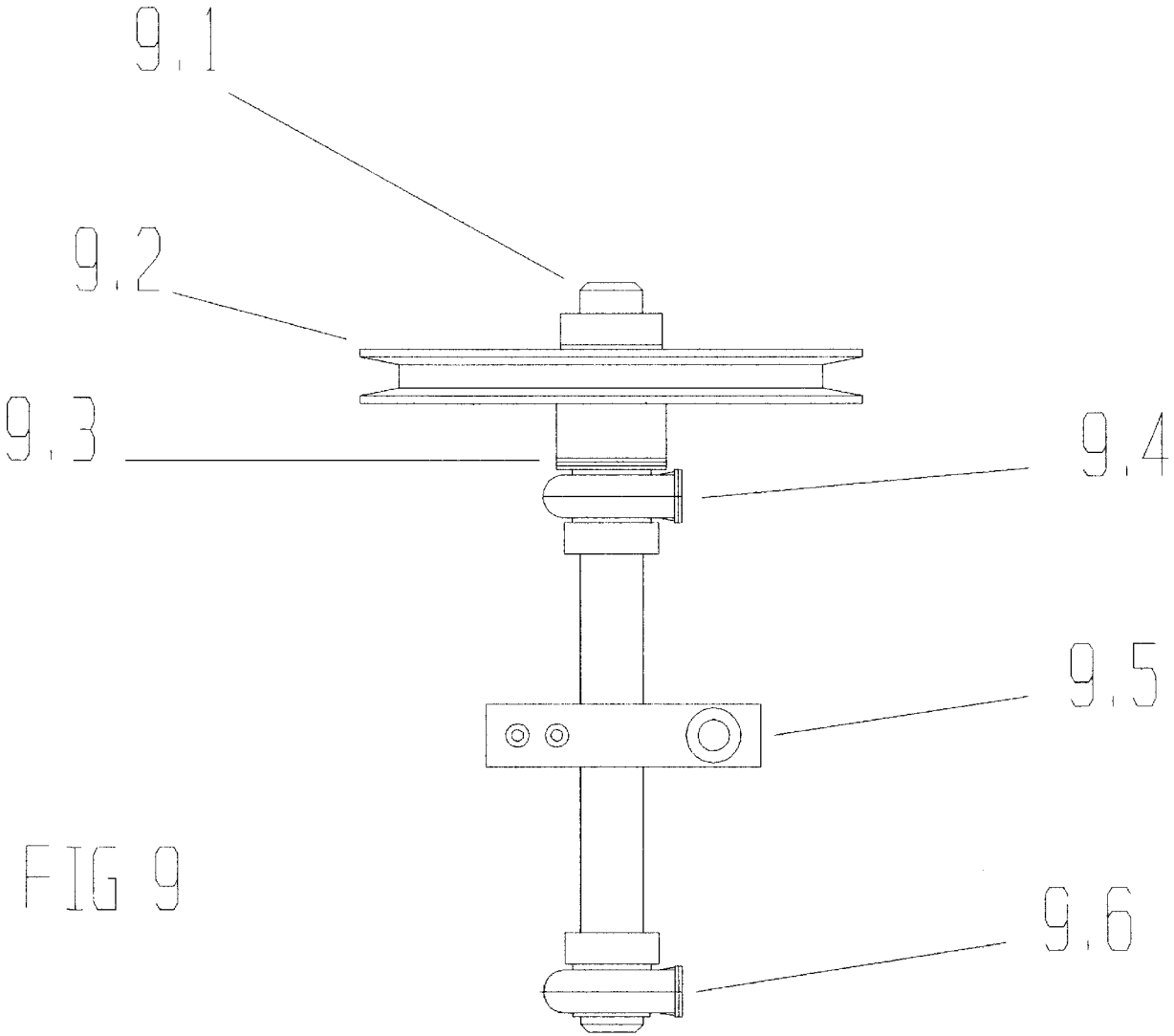
FIG. 9: Resistance System Drive Spindle

A detail of the Resistance Drive Spindle assembly is shown in FIG. 9. 9.1 refers to the spindle shaft. 9.2 shows the side view of the wheel. 9.3 shows the Thrust Bearing. 9.4 refers to the Top Radial Bearing. 9.5 refers to the Drive Hub. The Drive Hub is attached to the Resistance Drive Spindle through a zero backlash compression clamp feature. A slot in the hub allows the inner bore to be reduced by tightening two cap screws. The hub also acts as a Horizontal Axis Pivot for the Ski Lever so that the skier can pick up the Ski Lever at the end of a stride and return it to the glide position. 9.6 refers to the Bottom Radial Bearing.

Figure 10:
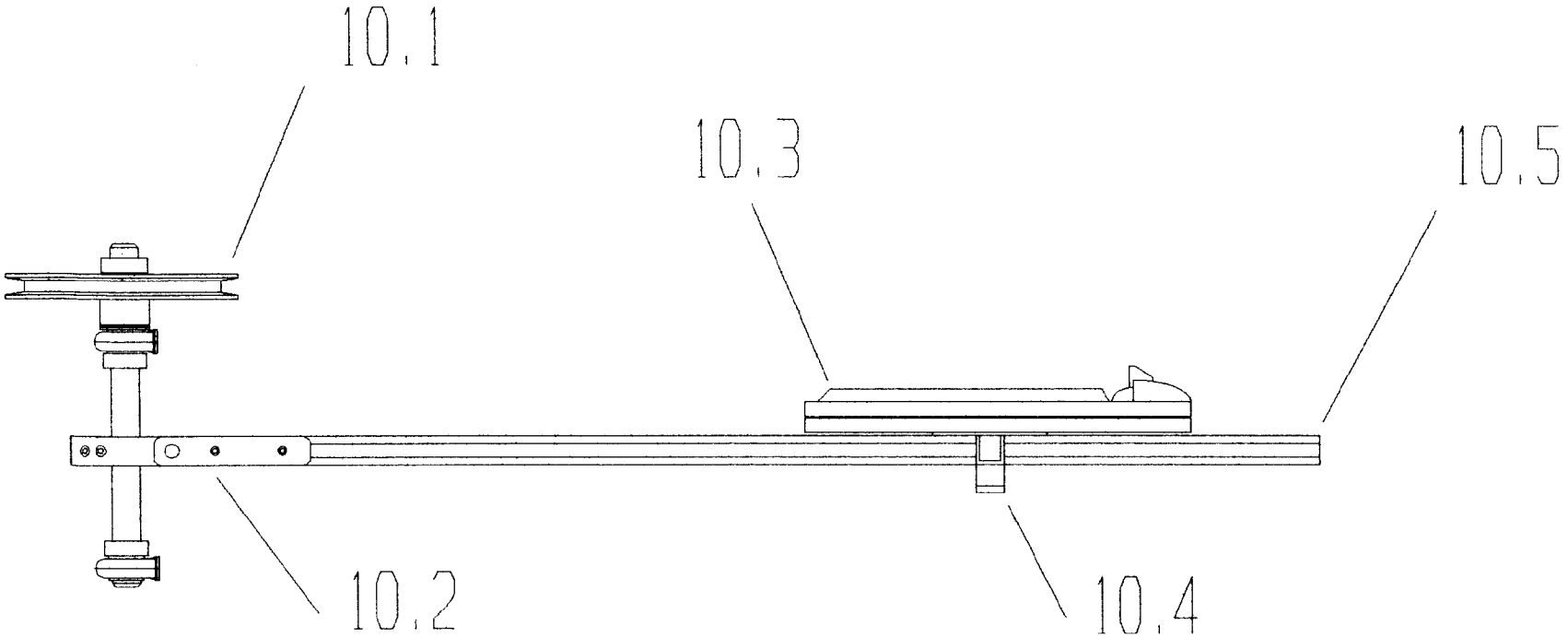
FIG. 10: Ski Lever Assembly Side Elevation

The Ski Lever Assembly side elevation is shown in FIG. 10. The Resistance System is shown at 10.1. The Horizontal Axis Pivot is shown at 10.2. 10.3 refers to the Binding Base Assembly. 10.4 refers to the Skid Block. 10.5 refers to the Ski Lever.

Figure 11:
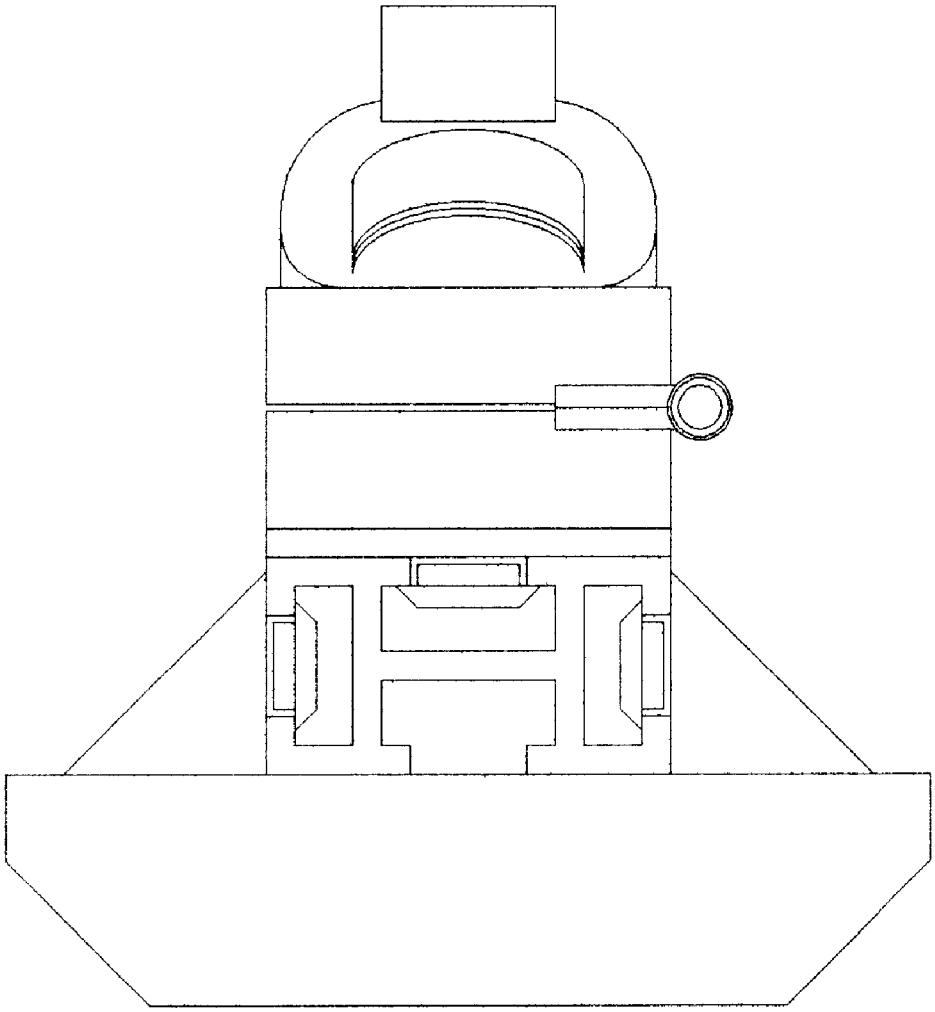
FIG. 11: Front elevation Ski Lever Assembly
Figure 12:
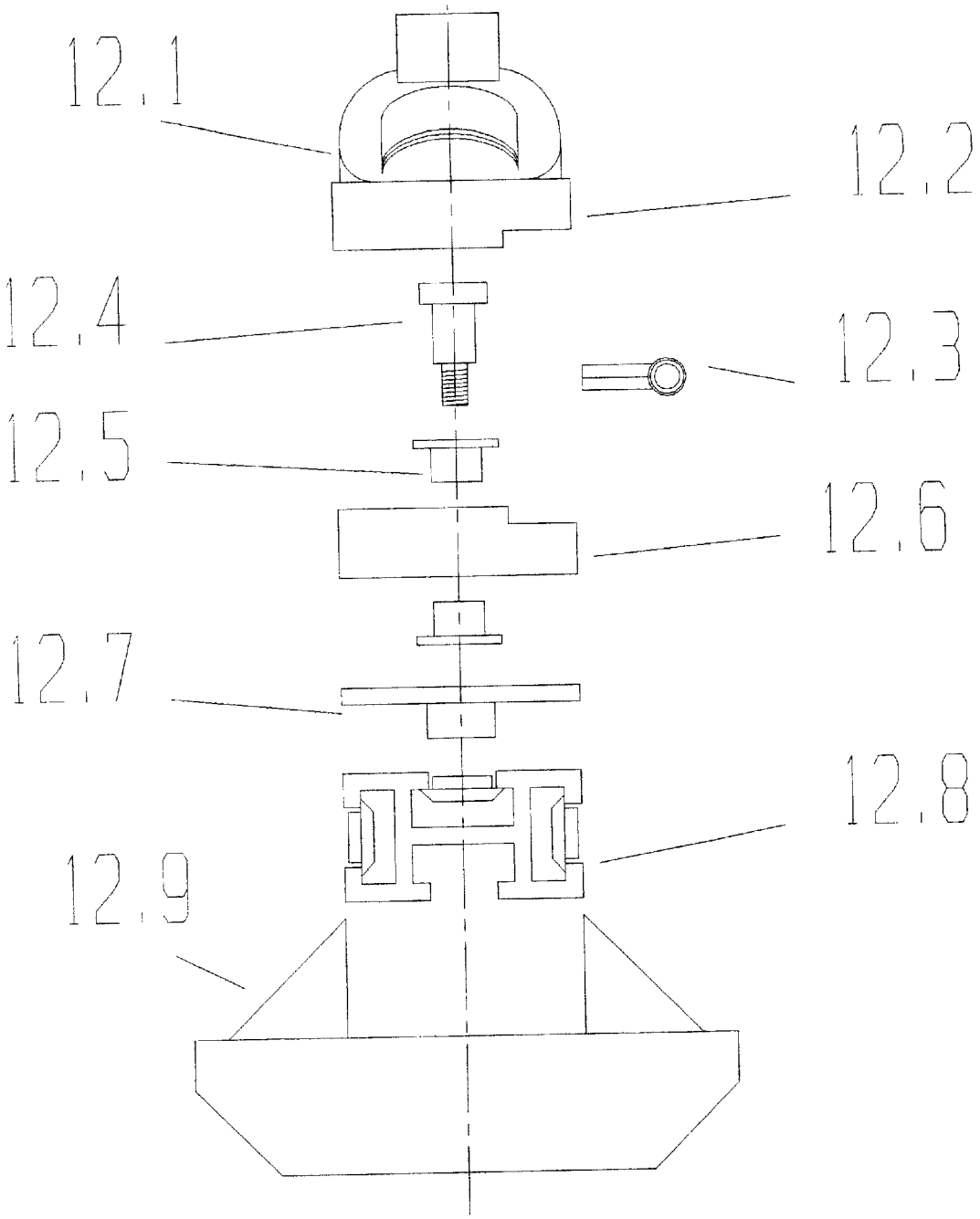
FIG. 12: Exploded view Ski Lever Assembly, and FIGS. 13(A) and 13(B), which show a user on the apparatus.
Figure 13A:
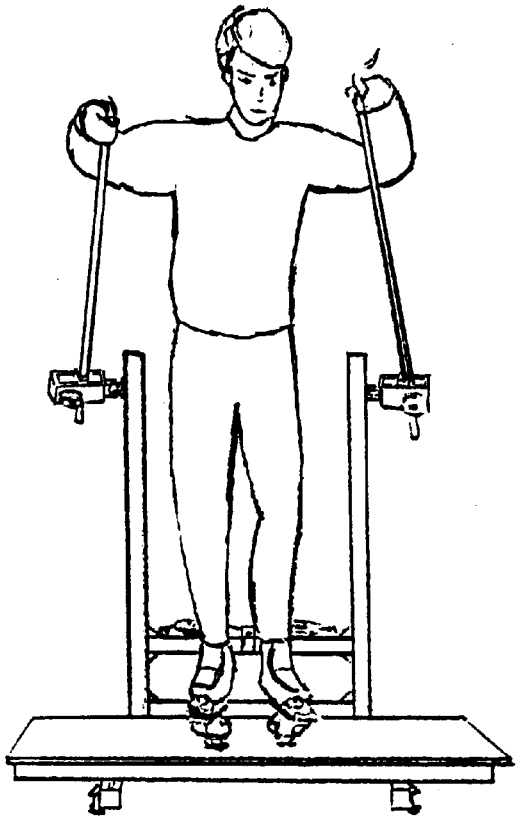
Figure 13B:
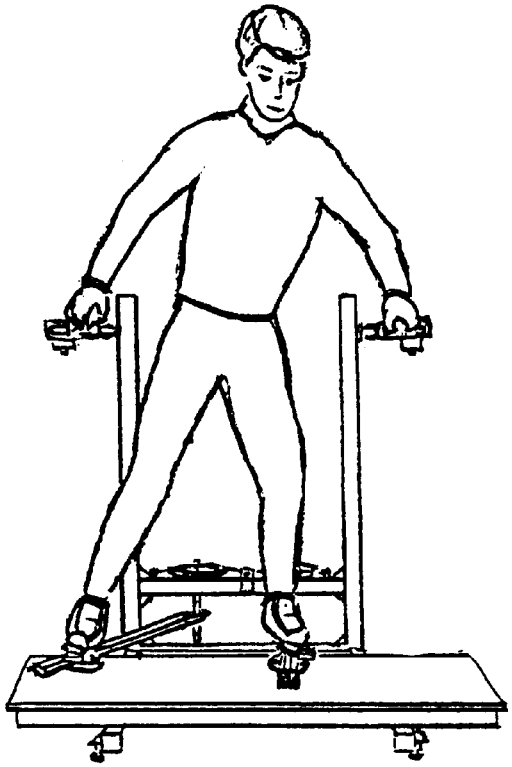

A detailed assembly of the front view of the Ski Lever Assembly is shown in FIG. 11, showing the end view of the Binding Base System. An exploded view of the Ski Lever Assembly is shown in FIG. 12. The Binding shown in 12.1 can be any of the commercially available binding systems offered. It is mounted to the Top Plate, 12.2, via wood screws supplied with the various binding systems. The Top Plate is attached to the Bottom Plate via a piano type Hinge, 12.3, which allows the Top Plate to rotate in the vertical plane so that the skiers ankle can rotate to set the "Ski" on edge. The Vertical Axis Pinion, 12.4 serves as an attachment point to the Ski Lever and allows the assembly of Bushings, 12.5 and Bottom Plate, 12.6 to rotate about the pinion in the horizontal plane. The combination of the horizontal and vertical axis of the Binding Base System and the rotational axis of the Ski Lever provide a system for closely approximating the the rotational axis of the Ski Lever provide a system for closely approximating the complex motion of leg, ankle and foot during an actual stride on snow. The Thrust Plate, 12.7, is a Delrin plastic bearing for the Bottom Base Plate/Ski Lever interface. The Ski Lever, 12.8, is a commercially available aluminum extrusion with channels for slot nuts that allow the Binding Base System and the Skid Block, 12.9, to be axially adjusted for the individual skiers stride. The Skid Block is a UHMWP plastic block that has been designed to afford mechanical grip when the Ski Lever is weighted to the side opposite of the Binding Base System Hinge, 12.3, while providing a low coefficient of friction for gliding on the Skid Plate, FIG. 2, 2.2.

What is claimed is:

1. An exercise apparatus for simulating cross-country skiing comprising:

a skid plate;

two vertical shafts two ski levers each pivotally mounted to the skid plate for independent and different horizontal pivot movement about respective shafts;

a binding bar mounted to each of the two ski levers for attachment to a foot of a user;

a ski lever resistance system connected to the two ski levers to provide resistance to the horizontal pivoting of each ski lever; and tension adjustable resistance wheel attached to each of the vertical shafts and a resistance belt contacting each of the wheels to provide resistance to movement of the ski levers.

2. The exercise apparatus of claim 1 wherein the ski levers are also pivotally mounted for vertical movement.

3. The exercise apparatus of claim 1 wherein the binding bars mounting to the ski levers allows for pivotal movement of the binding bars about a horizontal axis.

4. The exercise apparatus of claim 2 wherein the binding bars mounting to the ski levers allows for pivotal movement of the binding bars about a horizontal axis.

5. The apparatus of claim 2 wherein the ski lever resistance system comprises a pivotal drive wheel attached to the vertical shaft and with a resistance belt contacting the wheel to provide the resistance.

6. The apparatus of claim 3 wherein the ski lever resistance system comprises a pivotal drive wheel attached to the vertical shaft and with a resistance belt contacting the wheel to provide the resistance.

7. The apparatus of claim 4 wherein the ski lever resistance system comprises a pivotal drive wheel attached to the vertical shaft and with a resistance belt contacting the wheel to provide the resistance.

8. The apparatus of claim 4 wherein a tensioner is attached to the resistance belt to increase and decrease the tensioner of the resistance belt to provide increased and decreased resistance to the horizontal movement of the ski levers.

9. The apparatus of claim 5 wherein a tensioner is attached to the resistance belt to increase and decrease the tensioner of the resistance belt to provide increased and decreased resistance to the horizontal movement of the ski levers.

10. The apparatus of claim 6 wherein a tensioner is attached to the resistance belt to increase and decrease the tensioner of the resistance belt to provide increased and decreased resistance to the horizontal movement of the ski levers.

11. The apparatus of claim 7 wherein a tensioner is attached to the resistance belt to increase and decrease the tensioner of the resistance belt to provide increased and decreased resistance to the horizontal movement of the ski levers.

12. The exercise apparatus of claim 5 wherein there is a pole drive assembly attached to the skid plate for supporting ski poles of the user and wherein the pole drive assembly is movably attached to the skid plate to allow ski poles supported therein to pivot vertically and horizontally.

13. The exercise apparatus of claim 6 wherein there is a pole drive assembly attached to the skid plate for supporting ski poles of the user and wherein the pole drive assembly is movably attached to the skid plate to allow ski poles supported therein to pivot vertically and horizontally.

14. The exercise apparatus of claim 7 wherein there is a pole drive assembly attached to the skid plate for supporting ski poles of the user and wherein the pole drive assembly is movably attached to the skid plate to allow ski poles supported therein to pivot vertically and horizontally.

15. The exercise apparatus of claim 1 wherein there is a pole drive assembly attached to the skid plate for supporting ski poles of the user and wherein the pole drive assembly is movably attached to the skid plate to allow ski poles supported therein to pivot vertically and horizontally.

16. The exercise apparatus of claim 12 wherein the pole drive assembly provides resistance to back and forth movement of the ski poles within the pole drive assembly.

17. The exercise apparatus of claim 13 wherein the pole drive assembly provides resistance to back and forth movement of the ski poles within the pole drive assembly.

18. The exercise apparatus of claim 14 wherein the pole drive assembly provides resistance to back and forth movement of the ski poles within the pole drive assembly.

19. The exercise apparatus of claim 15 wherein the pole drive assembly provides resistance to back and forth movement of the ski poles within the pole drive assembly.

* * * * *